US006758680B2

(12) United States Patent
Duquerroy et al.

(10) Patent No.: US 6,758,680 B2
(45) Date of Patent: Jul. 6, 2004

(54) COAXIAL CONNECTOR FOR INTERCONNECTING PRINTED CIRCUIT BOARDS

(75) Inventors: Patrick M. Duquerroy, Seligenstadt (DE); Blaise Rithener, Vevey (CH); Sébastien Kempter, Aigle (CH)

(73) Assignee: Tyco Electronics Decolletage S.A., Saint-Maurice (CH)

( * ) Notice: Subject to any disclaimer, the term of this patent is extended or adjusted under 35 U.S.C. 154(b) by 0 days.

(21) Appl. No.: 10/228,674

(22) Filed: Aug. 27, 2002

(65) Prior Publication Data

US 2003/0060069 A1 Mar. 27, 2003

(30) Foreign Application Priority Data

Aug. 31, 2000 (EP) ..... 01121015

(51) Int. Cl.[7] ..... H01R 9/09

(52) U.S. Cl. ..... 439/63

(58) Field of Search ..... 439/63, 188, 944, 439/581, 578, 582, 319, 74, 75, 82, 66, 81, 246, 247, 262–264, 259; 324/158, 754, 72.5, 73; 200/1, 51.09, 51.1, 283, 250, 51.12

(56) References Cited

U.S. PATENT DOCUMENTS

| | | | | |
|---|---|---|---|---|
| 4,740,746 A | * | 4/1988 | Pollock et al. | 324/761 |
| 5,466,160 A | | 11/1995 | Ogura | 439/63 |
| 5,477,159 A | * | 12/1995 | Hamling | 324/754 |
| 5,718,592 A | | 2/1998 | Hosler, Sr. et al. | 439/63 |

FOREIGN PATENT DOCUMENTS

| | | | |
|---|---|---|---|
| WO | WO 98/43323 | 10/1998 | H01R/17/12 |

* cited by examiner

*Primary Examiner*—P. Austin Bradley
*Assistant Examiner*—Phuongchi Nguyen

(57) ABSTRACT

A coaxial connector for connecting a first contacting means and a second contacting means. The coaxial connector having a dielectric housing an inner conductor electrically connected to the first contacting means and resiliently biased between a second mated position and a second unmated position. An outer conductor positioned adjacent to the dielectric case and having a first outer conductor section electrically coupled with a second outer conductor section that is resiliently biased in respect to the first outer conductor section between a first mated position and a first unmated position. The second contacting means having a first contact pad that contacts the second outer conductor section when the second outer conductor section is in a mated position and a second contact pad that contacts the inner conductor section when the inner conductor section is in the mated position.

16 Claims, 2 Drawing Sheets

COAXIAL CONNECTOR FOR INTERCONNECTING PRINTED CIRCUIT BOARDS

BACKGROUND OF THE INVENTION

The invention relates to coaxial connectors for connecting two or more printed circuit boards. More particularly, the invention relates to a coaxial connector for connecting two printed circuit boards wherein a first printed circuit board can be connected to a second printed circuit board having a plurality of contact pads by only a single connector provided on the first printed circuit board.

DESCRIPTION OF THE PRIOR ART

When assembling electrical systems it is often necessary to connect two or more printed circuit boards to transmit high frequency signals from one printed circuit board to another. Coaxial connectors are conventionally used to establish a reliable signal connection between the circuit boards, especially when transmitting high-frequency signals. The coaxial connectors can be mated or unmated if required and provide a shielding that allows high-frequency signals to be transmitted with low signal loss and low noise.

One method of connecting two printed circuit boards is disclosed in U.S. Pat. No. 5,466,160. A surface mount type receptacle of a coaxial connector is disclosed that can be mounted on a substrate, e.g., a printed circuit board. The receptacle includes an inner connecting means and an outer connecting means fixed by a dielectric case. The inner and outer connecting means are permanently mounted onto the substrate, e.g., by a solder joint. The inner and outer connecting means are mounted on the dielectric case such that the receptacle can be mated with a conventional coaxial connector plug. The connector plug has a connecting wire that is received in the inner connecting means of the receptacle. The connector plug also has slots formed in a plurality of cantilever shaped spring arms for resilient contact with the outer connecting means of the receptacle.

Another method of connecting two printed circuit boards is disclosed in U.S. Pat. No. 5,718,592. A surface mountable electrical connector is disclosed having an insulating housing with a coaxial sub-assembly receiving cavity extending therein to a cavity bottom proximate a mounting face. The coaxial sub-assembly has center and outer conductors that can be electrically coupled via first and second contacts to a printed circuit board. The first contact comprises a resilient inner end located proximate the cavity bottom. The resilient inner end is engaged by portions of the center and outer conductors at an insertion end of the coaxial sub-assembly upon full insertion into the cavity. The first and second contacts have outer contact sections adapted to be surface mounted to the circuit board. The surface mountable electrical connector can be of male or female type and can be mated with a corresponding electrical coaxial connector.

WO 98/43323 discloses another method of connecting two printed circuit boards. A coaxial connection assembly is disclosed comprising a first connector and a second connector. The first connector has a resiliently movable inner contact that moves axially and abuts directly against a conductive circuit trace on a mating board. The second connector has a single-piece conductive part surface mounted on the board for plugging connection with a first connector outer conductor. The second connector has slots in an outer connecting means to form a plurality of cantilever shaped spring arms for resilient contact.

The preceding methods have the disadvantage of requiring two connectors to electrically connect the two printed circuit boards. At least one of the connectors is provided with slots in the outer conductor that form a plurality of cantilever shaped spring arms for resilient contact with the outer conductor of the corresponding connector. The cantilever arms are naturally exposed and can easily break or bend, and if the outer conductors are mis-aligned the cantilever arms can interfere with mating of the corresponding connector. Further, the spacing between the printed circuit boards is restricted to a small range because the connectors are unable to accommodate variations in distance.

It is therefore desirable to provide a coaxial connector for connecting two printed circuit boards wherein a first printed circuit board can be connected to a second printed circuit board by only a single connector provided on the first printed circuit board. It is further desirable to provide a coaxial connector whereby outer conductors having cantilever shaped resilient arms are not necessary to provide a retention force for electrical contact between corresponding conductors and tolerances in the distance between the first and second circuit board can be accommodated.

SUMMARY OF THE INVENTION

The invention relates to a coaxial connector for connecting a first contacting means and a second contacting means. The coaxial connector has a dielectric case, an inner conductor and an outer conductor. The dielectric case houses the inner conductor. The outer conductor is positioned substantially adjacent to the dielectric case and has a first outer conductor section electrically coupled with a second outer conductor section that is resiliently movable in respect to the first outer conductor section between a first mated position and a first unmated position.

DETAILED DESCRIPTION OF THE PREFERRED EMBODIMENT

Figure 1:
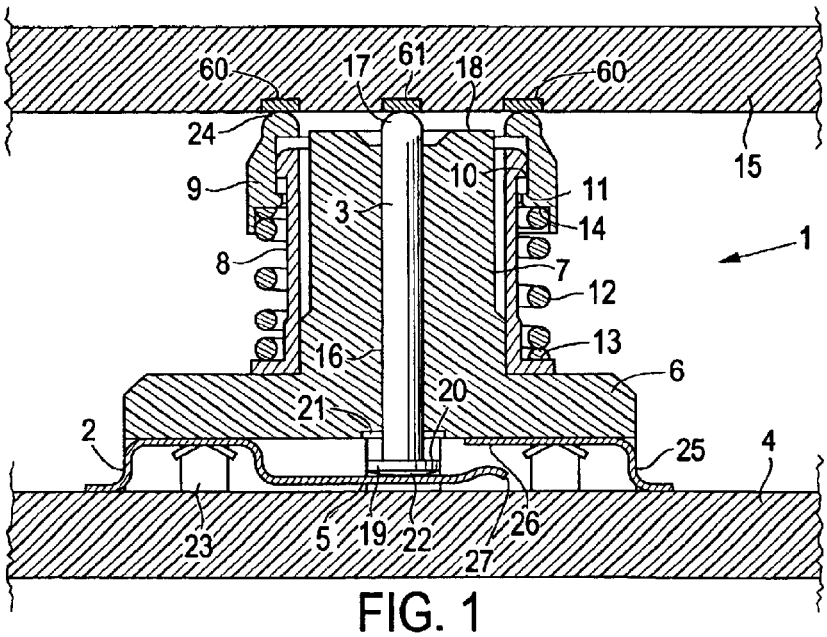
FIG. 1 is a cross-sectional view of a coaxial connector in a mated condition contacting two printed circuit boards according to a first embodiment.
Figure 6:
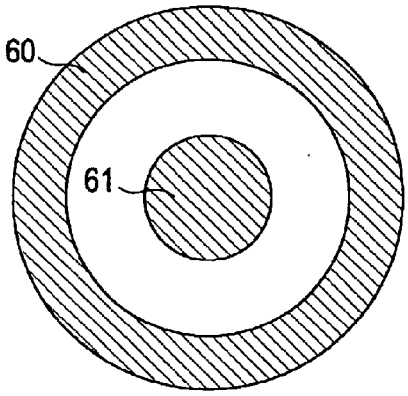
FIG. 6 shows a layout of a printed circuit board to be contacted with the coaxial connector according to the first and second embodiment of the invention.
Figure 5:
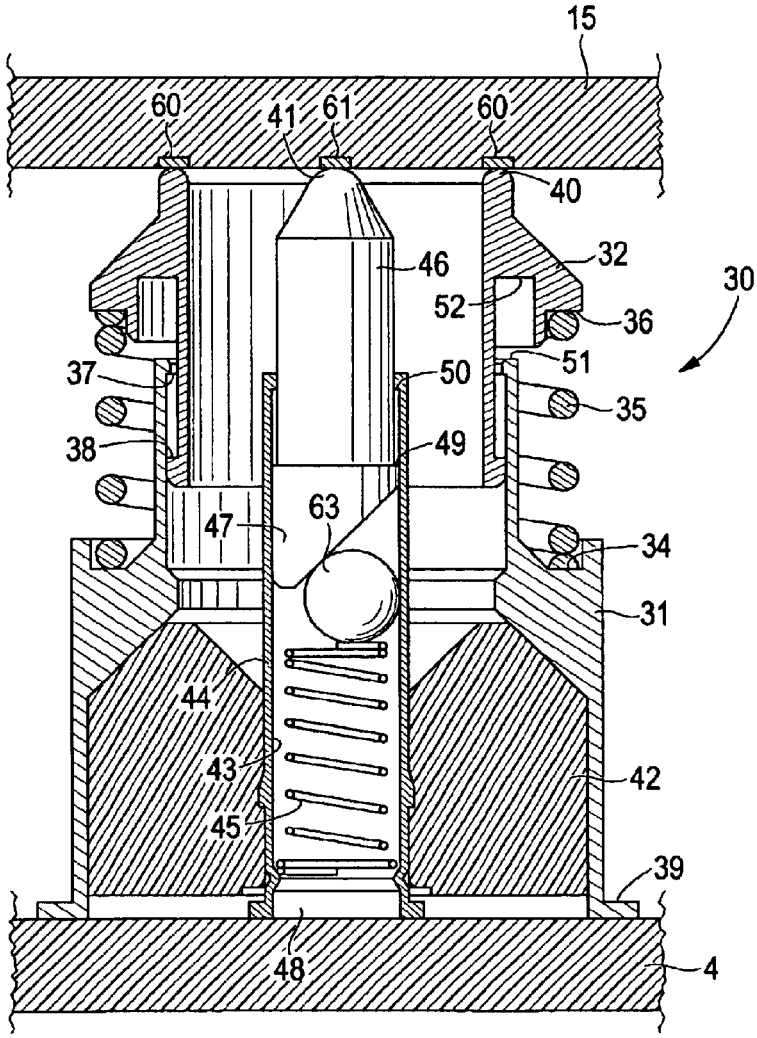
FIG. 5 is a cross-sectional view of a second embodiment of the coaxial connector.

FIGS. 1 through 5 show a first and second embodiment of a coaxial connector 1, 30, respectively. As shown in FIGS. 1 and 5, the first embodiment of the coaxial connector 1 and the second embodiment of the coaxial connector 30 are mounted on a first printed circuit board 4 and contact a second printed circuit board 15. The second printed circuit board has first and second contact pads 60, 61, shown in FIG. 6. The first contact pad 60 is substantially cylindrical in shape and the second contact pad 61 is substantially circular in shape and is circumscribed by the first contact pad 60. The first and second contact pads 60, 61 are arranged to provide a reliable and sufficient shielded contact for the first and second embodiments of the coaxial connectors 1, 30.

FIGS. 1 through 4 show the first embodiment of the coaxial connector 1. The coaxial connector 1 has a dielectric case 6, an outer conductor 8, 9 and an inner conductor 2, 3. The dielectric case 6 has a cylindrical portion 7 and is preferably made of a nonconductive material, such as plastic. The outer conductor has a first outer conductor section 8 and a second outer conductor section 9. The first outer conductor section 8 is substantially sleeve-shaped and is positioned adjacent to the cylindrical portion 7 of the dielectric case 6. The second outer conductor section 9 is substantially sleeve-shaped and is positioned adjacent to the first outer conductor section 8. The second outer conductor section 9 engages the first outer conductor section 8 and extends in a direction substantially perpendicular to a surface of the first printed circuit board 4. To prevent the second outer conductor section 9 from disengaging from the first outer conductor section 8 the first outer conductor section 8 has a first outer stopping shoulder 10 and the second outer conductor section 8 has a second outer stopping shoulder 11. The second outer conductor section 9 has an outer contacting portion 24 that contacts the second printed circuit board 15. The first and the second outer conductor sections 8, 9 may be stamped and formed from a single sheet.

Figure 4:
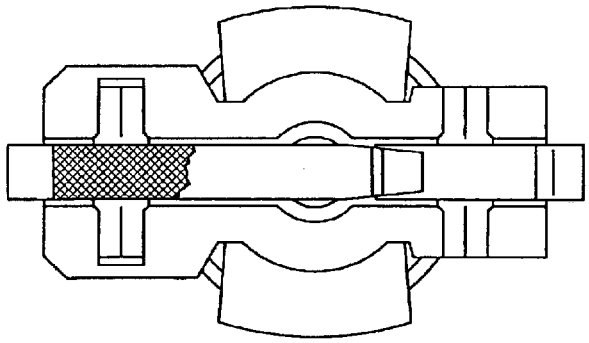
FIG. 4 is a bottom view of the coaxial connector of FIG. 2.
Figure 2:
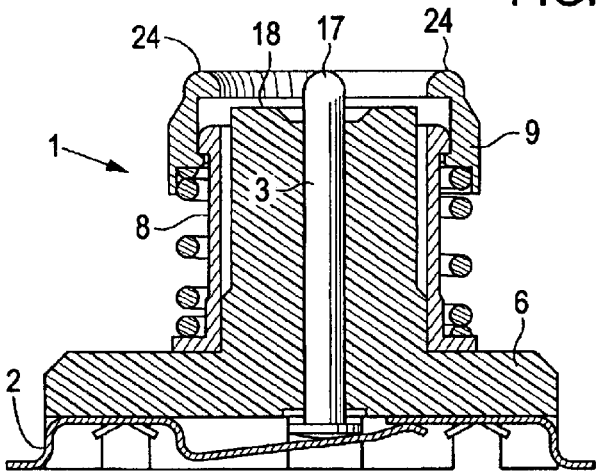
FIG. 2 is a cross-sectional view of FIG. 1 of the coaxial connector in an unmated condition.
Figure 3:
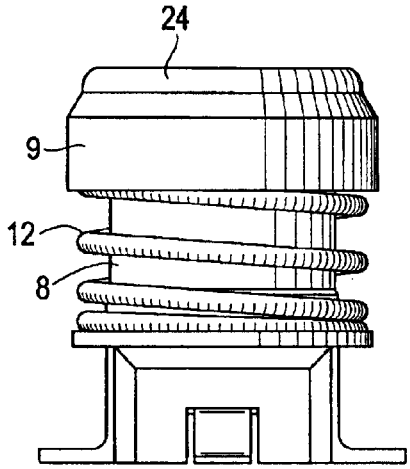
FIG. 3 is a plan view of the coaxial connector of FIG. 2.

Shown in FIGS. 1 through 3, surrounding the first outer conductor section 8 is a cylindrical shaped outer spring 12. To position the outer spring 12, the first outer conductor section 8 comprises a first spring supporting means 13 and the second outer conductor section 9 comprises a second spring supporting means 14. The outer spring 12 is arranged enabling resiliency between the first outer conductor section 8 and the second outer conductor section 9. The outer spring 12 is not covered and, therefore, can be easily replaced if other contacting forces are necessary or if the outer spring 12 is damaged.

FIG. 2 shows the coaxial connector 1 in an unmated condition. As no mating force is provided, the outer spring 12 pushes the second outer connector section 9 to a final position that is defined by the first outer stopping shoulder 10 of the first outer connector section 8 and the second outer stopping shoulder 11 of the second outer connector section 9. In this position the outer spring 12 is under enough tension that sufficient force is provided to maintain an electrical coupling between the first and second outer conductor sections 8, 9 and reliable contact of the contact pads of the second printed circuit board 15 is maintained.

As shown in FIGS. 1 and 2, the coaxial connector 1 has an inner conductor having a first inner conductor section 2 and a second inner conductor section 3. The first inner conductor section 2 comprises a resilient cantilever arm portion 5 that provides a resilient force substantially perpendicular to a surface of the first printed circuit board 4. The second inner conductor section 3 is substantially cylindrical in shape and slidably mounted in a cavity 16 of the dielectric case 6. The second inner conductor section 3 has an inner contacting portion 17 that contacts the second contact pad 61 of the second printed circuit board 15 and protrudes beyond an end portion 18 of the dielectric case 6. The second inner conductor section 3 extends in an axial direction that is depicted by a dashed line in FIGS. 1 through 4.

An end of the second inner conductor section 3 has an enlarged portion 19 that forms a retention shoulder 20 for abutment against a shoulder 21 of the dielectric case 6. The retention shoulder 20 and the shoulder 21 limit the outward extension of the inner contacting portion 17 beyond the end portion 18 of the dielectric case 6. An abutment surface 22 of the second inner conductor section 3 abuts the resilient cantilever arm portion 5 of the first inner conductor section 2. The resilient cantilever arm portion 5 urges the second inner conductor section 3 towards the contact pad of the second printed circuit board 15. In this embodiment the resilient cantilever arm portion 5 is stamped and formed from a resilient sheet. A retention part 23 is provided to fix the dielectric case 6 and give support to the first inner conductor section 2 to define the resilient force of the resilient cantilever arm portion 5.

The first inner conductor section 2 is mounted on the first printed circuit board 4, e.g., by a surface mount solder connection. The surface mount solder connection provides an electrical connection of the inner conductor 2, 3 to a circuit trace of the printed circuit board 4.

FIG. 2 shows the coaxial connector 1 in the unmated condition. In the unmated condition, the second inner conductor section 3 is in an expanded condition and protrudes the farthest from the dielectric case 6. The retention shoulder 20 of the second inner conductor section 3 is supported by the shoulder 21 of the dielectric case 6. Preferably the second inner conductor section 3 and the second outer conductor section 9 expand to substantially the same distance from the dielectric 6 in the axial direction in the unmated condition.

Shown in FIGS. 1 and 2, a switch contact 25 is electrically coupled to the first printed circuit board 4. The switch contact 25 has a contacting portion 26 that comes into contact with the resilient cantilever arm portion 5 of the first inner conductor section 2 the unmated condition. A contacting portion 27 of the cantilever shaped arm portion 5 contacts the contact portion 26 of the switch contact 25. Thus switch contact 25 is closed while the coaxial connector 1 is in an unmated condition, FIG. 2, and is open when the coaxial connector 1 is in a mated condition, FIG. 1. The switch contact 25 can be used as an indicator as to whether a second printed circuit board 15 is connected to the coaxial connector 1.

FIG. 5 shows the second embodiment of the coaxial connector 30. The coaxial connector 30 has a second dielectric 42, and outer conductor 31, 32 and an inner conductor 46. The outer conductor comprises a third outer conductor section 31 and a fourth outer conductor section 32. The third outer conductor section 31 and the fourth outer conductor section 32 are substantially cylindrical in shape. The fourth outer conductor section 32 is slidably mounted inside the third outer conductor section 31.

The third outer conductor section 31 has a spring supporting shoulder 34 to provide support for a second outer spring 35. The fourth outer conductor section 32 has a spring retention shoulder 36 to provide support for the second outer spring 35. The third outer conductor section 31 and the fourth outer conductor section 32 each have a stopping shoulder 38, 37, respectively. The stopping shoulders 37, 38 are positioned substantially parallel to each other such that when the fourth outer conductor section 32 moves completely out of engagement with the third outer conductor section 31 the stopping shoulders 37, 38 abut.

The third outer conductor section 31 has a contact portion 39 that can be used to electrically contact circuits on the first printed circuit board 4. The fourth outer conductor section 32 has a contacting area 40. The contacting area 40 is pressed to the corresponding contact pads 60 on the second printed circuit board 15 by the second outer spring 35.

The coaxial connector 30 has a second dielectric case 42 provided with a cavity 43. The cavity 43 has a sleeve 44 preferably made of a conductive material such as a sheet material. The sleeve 44 provides guidance for an inner spring 45 and a third inner conductor section 46. The third inner conductor section 46 has a substantially cylindrical shape and has a contact portion 41 for contacting the contact pad 61 of the second printed circuit board 15. The third inner conductor section 46 has an end portion 47 inclined in a radial direction. In the sleeve 44, a first end of the inner spring 45 is positioned adjacent a contact pod 48. The contact pod 48 and/or the sleeve 44 is electrically mounted on the first printed circuit board 4.

A second end of the inner spring 45 engages with a ball 63. The ball 63 is electrically conductive and provides a reliable electrical connection between the third inner conductor section 46 and the electrical conductive sleeve 44 and/or the electrical conductive spring 45. The end portion 47 of the third inner conductor section 46 has a third shoulder 49 that abuts a fourth shoulder 50 of the sleeve 44 when the third inner conductor section 46 is fully extended in an unmated position. The fourth shoulder 50 and the third shoulder 49 prevent the third inner conductor section 46 from disengaging from the sleeve 44.

The fourth outer connector section 32 has a fifth shoulder 52. The fifth shoulder 52 engages with a stop 51 at an end of the third outer connector section 31. If the second outer spring 35 is applied with a force that may damage or destroy the second outer spring 35, the fifth shoulder 52 engages the stop 51 to prevent the second outer spring 35 from being overloaded.

Advantageously the first and second embodiment of the coaxial connectors 1, 30 can connect a first printed circuit board 4 to a second printed circuit board 15 by only a single connector 1, 30 provided on the first printed circuit board 4. The second printed circuit board 15 having contact pads 60, 61 thereon which are substantially in the shape of the inner and outer conductors of the coaxial connectors 1, 30.

Furthermore, it is not necessary to provide outer conductors having cantilever shaped resilient arms to provide a sufficient retention force of electrical contact between the corresponding conductors. The outer conductor, especially the second outer conductor section, can be provided as a more or less solid part without parts that are subject to breakage or bending.

As the inner and the outer conductor are resiliently adaptable in their extension, e.g. their lengths, tolerances in the distance between the first and second contacting means, e.g. printed circuit boards, can be accommodated. Therefore, it is not necessary to exactly adjust the lateral position of the coaxial connectors 1, 30 while mating the inner and outer conductors of the coaxial connectors 1, 30 with the second contacting means. A radial misalignment of the coaxial connectors 1, 30 in respect to the second contacting means is, therefore, tolerated as long as the inner and outer conductors of the coaxial connectors 1, 30 contact the second contacting means in the intended manner.

What is claimed is:

1. A coaxial connector for connecting a first contacting means and a second contacting means, comprising:

a dielectric housing having an inner conductor therein, the inner conductor having a first inner conductor section electrically coupled with a second inner conductor section that is resilient movable between a second mated position and a second unmated position in respect to the first inner conductor section, the second inner conductor section being resiliently biased in respect to the first inner conductor section, the first inner conductor section being a cantilever arm; and an outer conductor positioned substantially adjacent to the dielectric housing and having a first outer conductor section electrically coupled with a second outer conductor section that is resiliently movable in respect to the first outer conductor section between a first mated position and a first unmated position.

2. The coaxial connector of claim 1, further comprising a stopping means to limit the movement of the second inner conductor section between the second mated position and the second unmated position.

3. The coaxial connector of claim 1, wherein the first inner conductor section is mounted on the first contacting means.

4. A coaxial connector for connecting a first contacting means and a second contacting means, comprising:

a dielectric housing having an inner conductor therein, the inner conductor having a first inner conductor section electrically coupled with a second inner conductor section that is resilient movable between a second mated position and a second unmated position in respect to the first inner conductor section, the second inner conductor section being resiliently biased in respect to the first inner conductor section;

an outer conductor positioned substantially adjacent to the dielectric housing and having a first outer conductor section electrically coupled with a second outer conductor section that is resiliently movable in respect to the first outer conductor section between a first mated position and a first unmated position;

a stopping means to limit the movement of the second inner conductor section between the second mated position and the second unmated position; and a switch contact that is mounted on the first contacting means and contacts the first inner conductor section when the second inner conductor section is in the second unmated position.

5. A coaxial connector for connecting a first contacting means and a second contacting means comprising:

a dielectric housing having an inner conductor therein; and an outer conductor positioned substantially adjacent to the dielectric housing and having a first outer conductor section electrically counted with a second outer conductor section that is resiliently movable in respect to the first outer conductor section between a first mated position and a first unmated position;

wherein the outer conductor has a stopping means that prevents the second outer conductor section from disengaging from the first outer conductor section.

6. The coaxial connector of claim 5, wherein the dielectric case has a cavity housing a spring that is electrically connected to the inner conductor and is positioned substantially adjacent to the inner conductor and resiliently biases the inner conductor between the second mated position and the second unmated position.

7. The coaxial connector of claim 6, further comprising a stopping means to limit the movement of the inner conductor between the second mated position and the second unmated position.

8. The coaxial connector of claim 6, wherein the spring is electrically connected to the first contacting means.

9. The coaxial connector of claim 8, wherein the spring is electrically connected to the inner conductor by a conductive ball.

10. A coaxial connector arrangement for providing a coaxial connection between two circuit boards, comprising:

a first circuit board, having mounted thereon;

a dielectric housing having an inner conductor housed therein, the inner conductor being electrically connected to the first circuit board and resiliently biased toward a second unmated position and movable between a second mated position and a second unmated position; and an outer conductor positioned substantially adjacent to the dielectric case and having a first outer conductor section electrically coupled with a second outer conductor section that is resiliently biased toward a first unmated position and moveable with respect to the first outer conductor section between a first mated position and a first unmated position, and a second circuit board having formed thereon a first contact pad that contacts the second outer conductor section when the second outer conductor section is in a mated position and a second contact pad that contacts the inner conductor section when the inner conductor section is in the mated position.

11. The coaxial connector arrangement of claim 10, for further comprising a stopping means to limit the movement of the inner conductor between the second mated position and the second unmated position.

12. The coaxial connector arrangement of claim 10, wherein the outer conductor has a stopping means that limits the movement of the second outer conductor section from the first unmated position to the first mated position.

13. The coaxial connector arrangement of claim 10, wherein the dielectric case has a cavity housing a spring that is electrically connected to the inner conductor and is positioned substantially adjacent to the inner conductor and resiliently biases the spring between the second mated position and the second unmated position.

14. The coaxial connector arrangement of claim 13, wherein the spring is electrically connected to the inner conductor by a conductive ball.

15. A coaxial connector for connecting a first contacting means and a second contacting means, comprising:

a dielectric housing having an inner conductor housed therein, the inner conductor being electrically connected to the first contacting means and resiliently biased toward a second unmated position by a cantilever arm and movable between a second mated position and a second unmated position;

an outer conductor positioned substantially adjacent to the dielectric housing and having a first outer conductor section electrically coupled with a second outer conductor section that is resiliently biased toward a first unmated position and moveable with respect to the first outer conductor section between a first mated position and a first unmated position; and a second contacting means having a first contact pad that contacts the second outer conductor section when the second outer conductor section is in the first mated position and a second contact pad that contacts the inner conductor section when the inner conductor section is in the second mated position.

16. The coaxial connector of claim 15, further comprising a switch contact that is mounted on the first contacting means and contacts the cantilever arm when the inner conductor is in the second unmated position.

* * * * *